US007263310B2

(12) United States Patent
Baek et al.

(10) Patent No.: US 7,263,310 B2
(45) Date of Patent: Aug. 28, 2007

(54) HOUSING ASSEMBLY OF OPC UNIT

(75) Inventors: Chung-guk Baek, Suwon-si (KR); Yong-baek Yoo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 34 days.

(21) Appl. No.: 10/858,284

(22) Filed: Jun. 2, 2004

(65) Prior Publication Data

US 2005/0084289 A1 Apr. 21, 2005

(30) Foreign Application Priority Data

Oct. 17, 2003 (KR) ..... 10-2003-0072423

(51) Int. Cl.
*G03G 15/00* (2006.01)

(52) U.S. Cl. ..... 399/116; 399/117

(58) Field of Classification Search ..... 399/110–114, 399/116, 117, 159, 166, 296
See application file for complete search history.

(56) References Cited

U.S. PATENT DOCUMENTS

| | | | | |
|---|---|---|---|---|
| 4,878,091 | A * | 10/1989 | Morita et al. | 399/224 |
| 5,486,898 | A * | 1/1996 | Fujii et al. | 399/112 |
| 2004/0005168 | A1* | 1/2004 | Baek | 399/116 |

FOREIGN PATENT DOCUMENTS

| | | |
|---|---|---|
| JP | 62-92969 | 4/1987 |
| JP | 5-11161 | 2/1993 |
| JP | 10-69206 | 3/1998 |
| JP | 2001-051553 | 2/2001 |
| JP | 2001-066889 | 3/2001 |
| JP | 2001-337571 | 12/2001 |
| JP | 2001-356545 | 12/2001 |
| JP | 2001-356549 | 12/2001 |
| KR | 10-293883 | 4/1998 |

OTHER PUBLICATIONS

Korean Official Action issued on Jul. 29, 2005, for Korean Patent Application No. 2003-72423.
Japanese Office Action dated Nov. 28, 2006 issued in JP 2004-265455.
Korean Office Action issued on Oct. 26, 2005 for Korean Patent Application No. 2003-72423.

* cited by examiner

*Primary Examiner*—David M. Gray
*Assistant Examiner*—Ryan Gleitz
(74) *Attorney, Agent, or Firm*—Stanzione & Kim, LLP

(57) ABSTRACT

A housing assembly of an OPC unit to protect an OPC drum in an image forming apparatus includes a main housing enclosing at least a half of a large-diameter OPC drum and provided with a main-opening selectively contacting a plurality of developing units and a plurality of sub-openings, a first housing and a second housing each mounted on a side of the main housing, a handle hingedly connected to the main housing, and a plurality of brackets mounted on opposite sides of the main housing. As a result, the housing assembly of the OPC unit allows easy development, electrification, exposure, image transfer and treatment of a waste toner, and reliability of the image developing process increases due to the fixation of the developing units. Also, since the exposure of the OPC drum is minimized, an area of the OPC drum to be contaminated can be reduced.

36 Claims, 4 Drawing Sheets

HOUSING ASSEMBLY OF OPC UNIT

CROSS-REFERENCE TO RELATED APPLICATIONS

This application claims the benefit of Korean Patent Application No. 2003-72423, filed on Oct. 17, 2003, in the Korean Intellectual Property Office, the disclosure of which is incorporated herein by reference.

BACKGROUND OF THE INVENTION

1. Field of the Invention

The present general inventive concept relates to a housing assembly of an organic photoconductive (OPC) unit, and in particular, to a housing assembly to protect an OPC drum on which an image to be printed is formed in an image forming apparatus.

2. Description of the Related Art

In general, an image forming apparatus, such as a copying machine, a printer, or a combined machine, is used for forming an image on an OPC medium and then printing the image on a recording medium. For example, a laser printer prints an image on a sheet of paper through a series of steps, e.g., forming a desired image on an OPC medium with a laser scanning unit (LSU) and then transferring a developed image onto a paper through an image transfer unit.

Such an image forming apparatus requires an OPC unit including an OPC medium for forming an image. For a mono-printer, a housing assembly of the OPC unit is typically formed in an integral structure to enclose not only an OPC drum but also a developing roller or the like.

A conventional housing assembly 10 of an OPC unit is described with reference to FIG. 1 by way of an example. The housing assembly 10 includes a main opening 14 through which an OPC drum 22 projects, and a sub-opening 12 that serves as an exposure window.

As shown in FIG. 1, the housing assembly 10 entirely protects toner, a toner stirrer 16 for supplying the toner, a toner feeding roller 18, a developing roller 20, an electrification roller 24, and an OPC drum 22.

The toner feeding roller 18 serves to transfer the toner to the developing roller 20 and is located adjacent to the developing roller 20, and the developing roller 20 is in contact with the OPC drum 22 with a developing nip or gap being formed between the developing roller 20 and the OPC drum 22, so that the developing roller 20 develops an image formed by a laser scan unit 26 with the toner received from the toner feeding roller 18 to form a developed image on the OPC drum 22.

As shown in FIG. 1, in general, the conventional housing assembly 10 is provided with a toner storage case 13 positioned higher than any of the developing roller 20 and the toner feeding roller 18, so that the toner can be moved by weight toward the developing roller 20 through the toner feeding roller 18.

However, such a housing assembly 10 for a mono image forming apparatus has a disadvantage in that it can not be employed in a color image forming apparatus provided with four respective color developers each for yellow, magenta, cyan and black.

In particular, in a color image forming apparatus of a multi-path type including one OPC medium and one image transfer medium, the OPC medium is developed while individually coming into contact with each developing unit in a state that a developing nip or gap is formed between the OPC medium and the developing unit. Therefore, it is not possible to employ such a construction of the conventional housing assembly that has been used in the conventional mono image forming apparatus provided with an developing roller, etc., in the color image forming apparatus, and it is required to develop a new housing assembly according to a novel concept.

Although a currently developed color image forming apparatus uses a hard type OPC drum, which is not a belt, it has to have a plurality of small-diameter OPC drums for colors and also a plurality of color developing units corresponding to the OPC drums. In the currently developed color image forming apparatus, an image is developed by the respective color developing units and transferred to a big-sized transfer belt from the respective OPC drums. Such a color image forming apparatus with the above construction is bulky and is manufactured at high costs.

In order to the solve the above problem, a method has been suggested, in which a plurality of movable developing units selectively contact one single small-diameter OPC drum one by one to develop a color image. However, this method has a problem of an unstable developing process because of the movable developing units, thereby losing reliability of a developing quality.

Alternatively, another method also has been suggested, which uses an OPC belt instead of the OPC drum. According to this method, a developing process is performed in a manner that respective color developing units are brought into contact with the OPC belt. However, it is difficult to maintain a constant tension of the OPC belt, and the OPC belt becomes loosened when being used for a predetermined time or a tension of the OPC belt attenuates, thereby causing a poor contact with the developing units.

SUMMARY OF THE INVENTION

Accordingly, in order to solve the above-mentioned and/or other problems, it is an aspect of the present general inventive concept to provide a housing assembly of an OPC unit to protect a large-diameter OPC drum of a color image forming apparatus and to allow a plurality of color developing units to selectively contact the OPC drum.

Another aspect of the present general inventive concept is to provide a housing assembly which has a large portion to cover an OPC drum so that the OPC drum is less subjected to contamination.

Additional aspects and advantages of the present general inventive concept will be set forth in part in the description which follows and, in part, will be obvious from the description, or may be learned by practice of the general inventive concept.

In order to achieve the above and/or other aspects of the present general inventive concept, there is provided a housing assembly of an OPC unit to protect an OPC drum, on which an image to be printed on a recording paper is formed in an image forming apparatus, the housing assembly including a main housing enclosing at least a half of the OPC drum, and at least one sub-housing mounted on a side of the main housing. Since at lease a half of the OPC drum can be protected, the OPC unit is blocked from environment and thus is less subjected to the contamination.

According to an aspect of the present general inventive concept, the main housing may be formed with a plurality of sub-openings and a main opening to receive one or more developing units. The plurality of sub-openings may include a first sub-opening through which the OPC drum comes into contact with an image transfer medium, a second sub-opening through which a waste toner is discharged, and a third sub-opening through which the OPC drum is exposed to light to modify a potential of an image forming surface of the OPC drum corresponding to an image. Also, the plurality of sub-openings may further include a fourth sub-opening through which an electrostatic elimination light guide and an electrification roller assembly are mounted on the main housing.

According to another aspect of the present general inventive concept, the sub-housing may include a first sub-housing mounted with an auger and a second sub-housing mounted with an electrostatic elimination light guide, and the main housing may include a handle hingedly connected to opposite sides of the main housing. Accordingly, the sub-openings facilitate exposure, electrification, image transfer, and removal of a waste toner, and the handle allows a user to easily mount and dismount the OPC unit.

In order to achieve the above and/or other aspects of the present general inventive concept, there is also provided a housing assembly of an OPC unit to protect an OPC drum on which an image to be printed on a recording paper is formed in an image forming apparatus, the housing assembly including a main housing enclosing at least a half of a large-diameter OPC drum having a diameter of 100 mm to 150 mm, a main opening through which a plurality of color developers selectively come into contact with the large-diameter OPC drum, and at least one sub-housing mounted on a side of the main housing.

According to an aspect of the present general inventive concept, the main housing may include a plurality of sub-openings through which the OPC drum is exposed, and through which a waste toner is removed, and the at least one sub-housing may include a first sub-housing provided with an auger and a second sub-housing provided with electrostatic elimination light guide.

According to another aspect of the present general inventive concept, the first sub-housing may be provided with an auger, the second sub-housing is provided with electrostatic elimination light guide, and the plurality of sub-openings may include a first sub-opening through which the OPC drum comes into contact with an image transfer medium, a second sub-opening through which the first sub-housing is mounted on the main housing, and through which the waste toner cleaned from the OPC drum is discharged, a third sub-opening through which the OPC drum is exposed to receive light to form an image, and a fourth sub-opening through which the second sub-housing is mounted on the main housing.

According to another aspect of the present general inventive concept, the first sub-housing may include a carriage space to temporarily carry the waste toner, an auger roller to unidirectionally transfer the waste toner, and a waste toner drop hole from which the waste toner escapes, and the second sub-housing may include a plurality of ribs. As a result, it is easy to treat the waste toner, and it is possible to efficiently prevent the removed waste toner from being scattered onto an OPC drum or an electrification roller.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
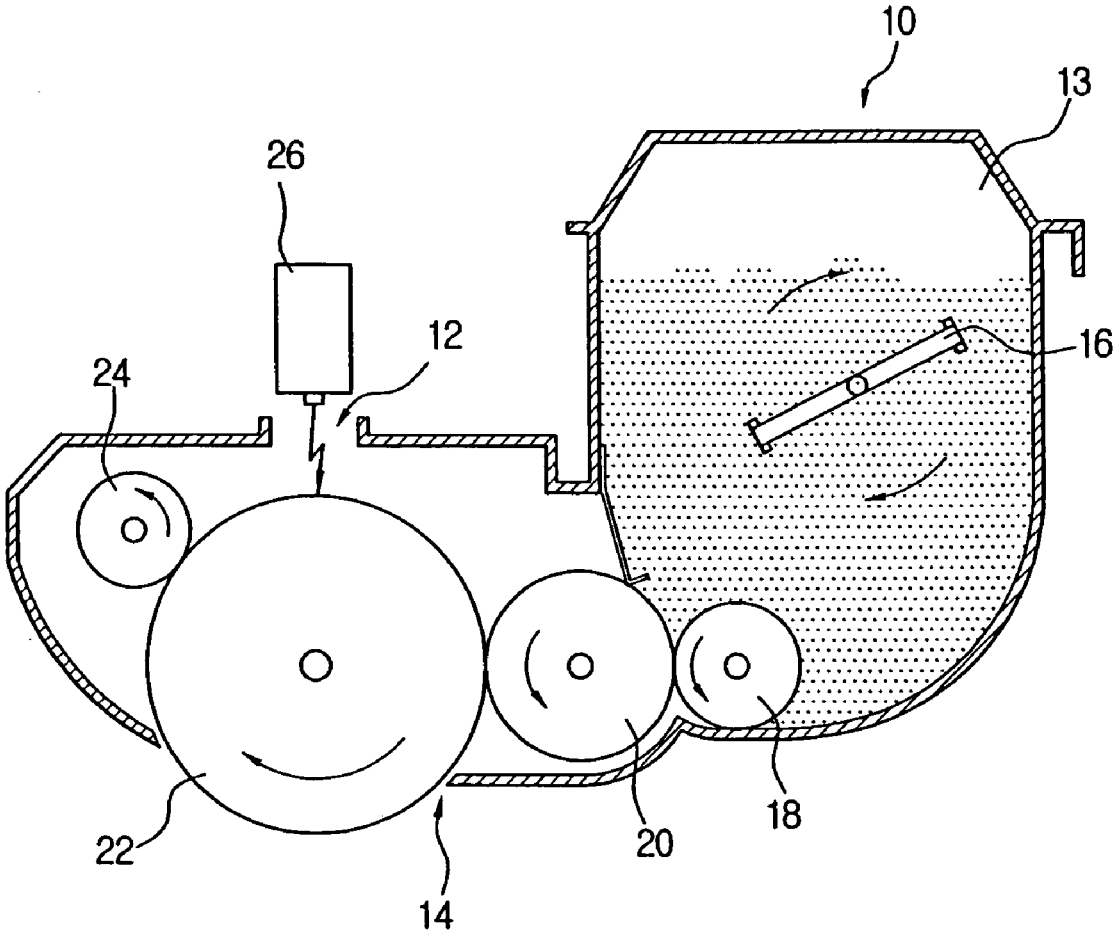
FIG. 1 (PRIOR ART)
FIG. 1 is a cross-sectional view illustrating a conventional housing assembly for protecting an OPC unit in a mono image forming apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
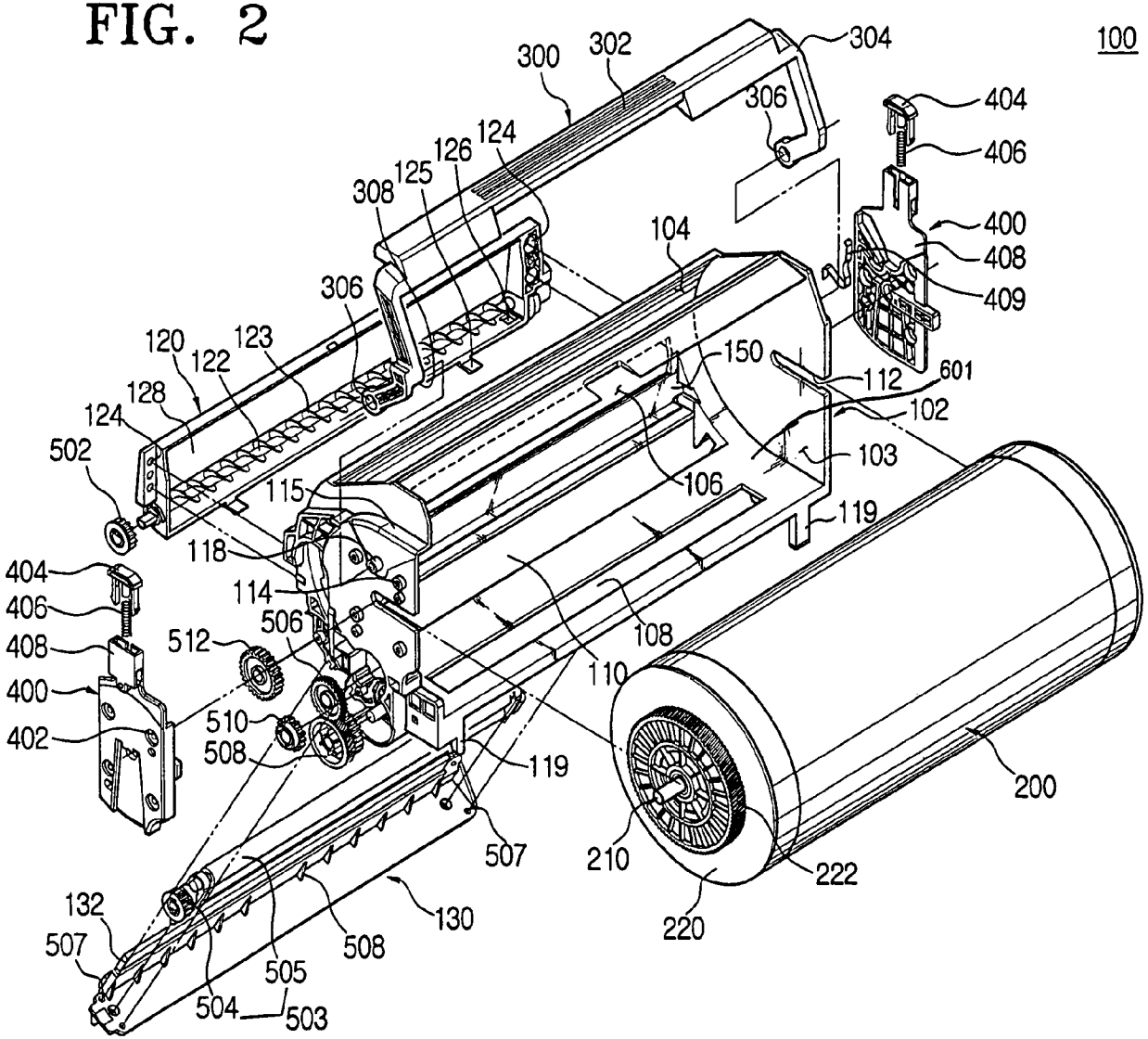
FIG. 2 is an exploded perspective view illustrating an OPC unit having a housing assembly according to an embodiment of the present general inventive concept.
Figure 3:
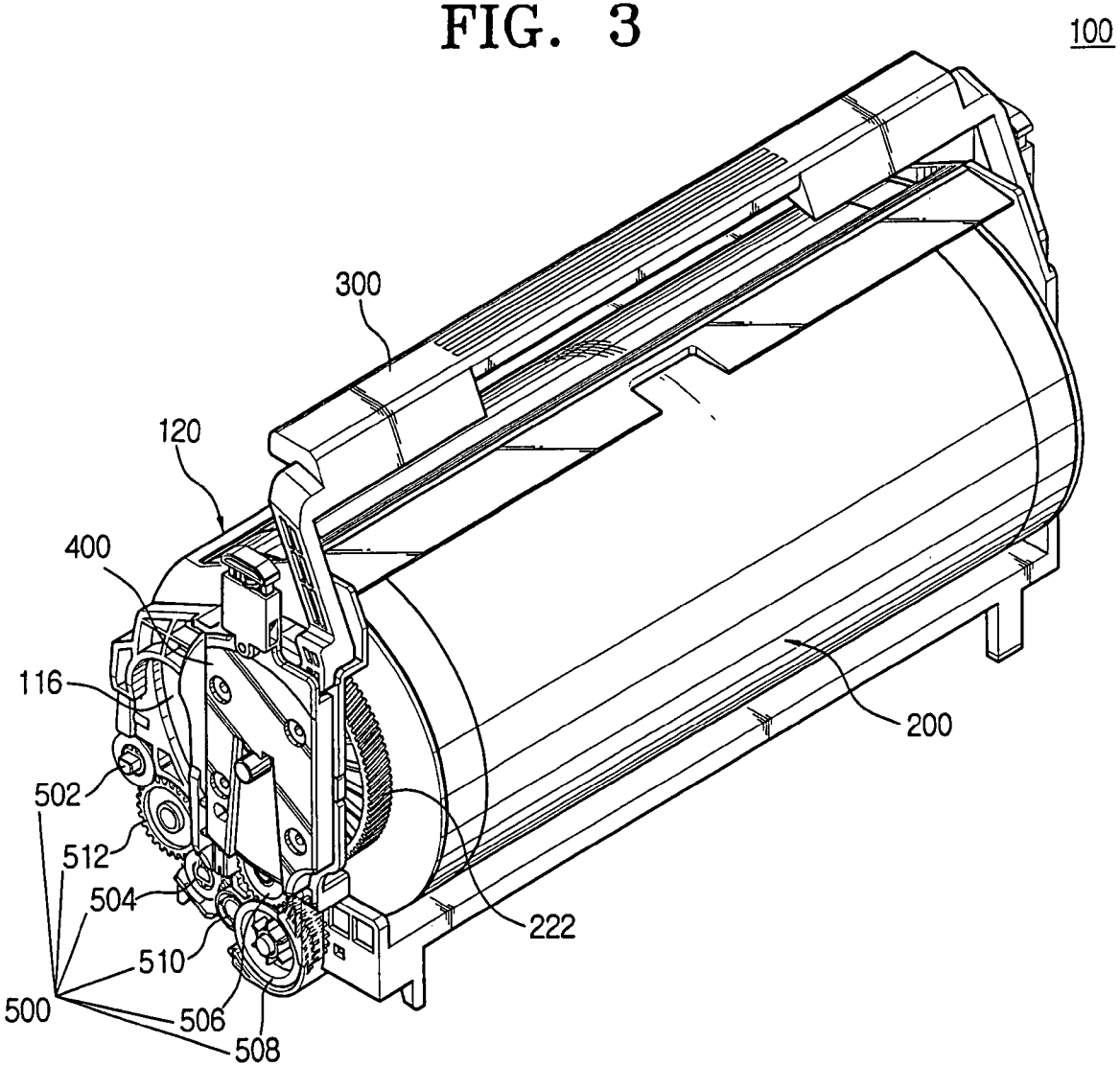
FIG. 3 is a perspective view illustrating the OPC unit shown in FIG. 2, in which the housing assembly and an OPC drum are shown in an assembled state.
Figure 4:
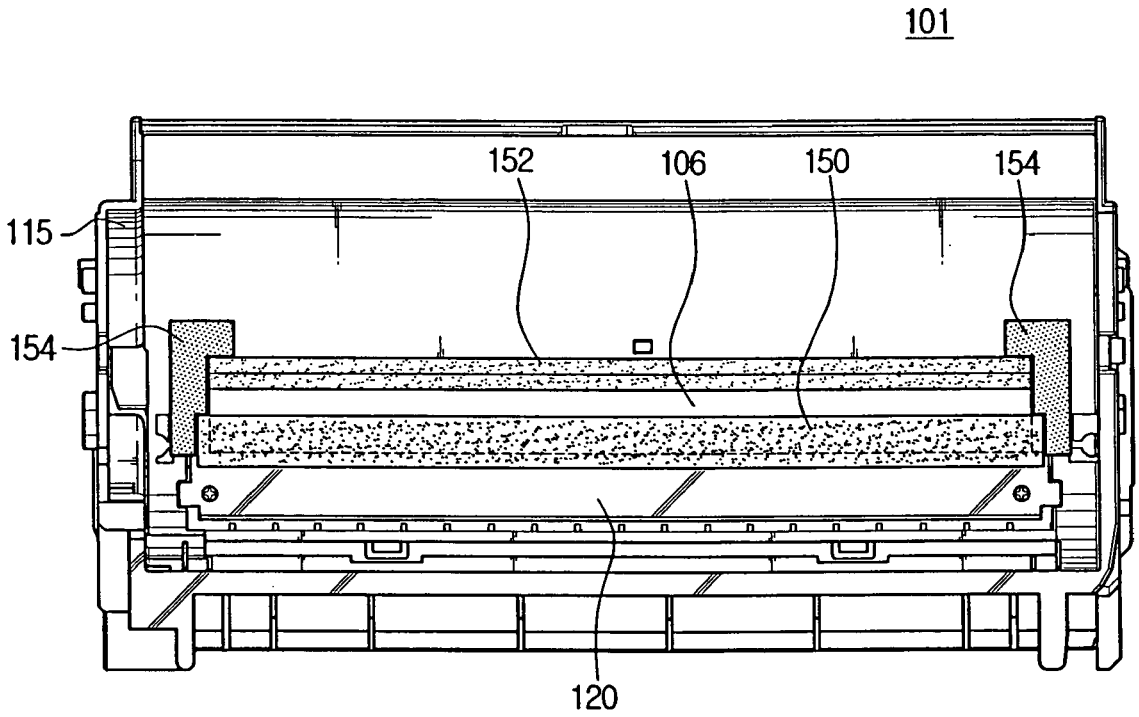
FIG. 4 is a front elevational view illustrating the housing assembly viewed from a main opening side.

FIG. 2 is an exploded perspective view illustrating an OPC unit 100 and a housing assembly according to an embodiment of the present general inventive concept, FIG. 3 is a perspective view illustrating the OPC unit shown in FIG. 2, in which the housing assembly and an OPC drum are shown in an assembled state, and FIG. 4 is a front elevational view illustrating the housing assembly viewed from an main opening side.

As can be seen from FIG. 2, the inventive housing assembly may include a main housing 102, a first sub-housing 120, a second sub-housing 130, a gear assembly 500, brackets 400 and a handle 300.

The main housing 102 can be formed with a main opening 103 and first to fourth sub-openings 104, 106, 108 and 110. The main opening 103 can be an open space largely occupying the main housing 102, substantially, as much as about ½ of the main housing 102. A large-diameter OPC drum 200 having a diameter of 100 mm to 150 mm can be mounted in the main housing 102 within the main opening 103. Four respective color developing units (not shown) can be selectively brought into contact with the OPC drum 200 through the main opening 103. As can be seen from FIG. 2, a supporter 119 can be formed below both sides of the main housing 102 to support the housing assembly. As can be seen from FIG. 2, a drum axle 210 can be inserted into a pair of slits 112 through the main opening 103, and then brackets 400 can be secured to the main housing 102, thereby completing the assembling of the OPC unit 100. Since at least half the large-diameter OPC drum 200 is covered as shown in FIG. 3, an area to be contaminated by an external environment can be reduced. Also, since the color developing units (not shown) come in contact with the large diameter OPC drum 200 in a fixed state, the reliability of a developing quality can increase.

Referring back to FIG. 2, the first sub-opening 104 can be formed on an upper end of the main housing 102, where an image transfer unit (not shown) is mounted, and the first sub-opening 104 serves as a passage to transfer an image developed on the OPC drum 200 to the image transfer unit (not shown). That is, the OPC drum 200 and the image transfer unit (not shown) can cooperate (communicate) with each other through the first sub-opening 104.

The second sub-opening 106 can be formed below a lower end of the first sub-opening 104 as can be seen from FIGS. 2 and 4. A cleaning blade 150 and a scattering prevention member 152, which prevents a waste toner from being scattered, can be provided on the main housing 102 at upper and lower sides of the second sub-opening 106, respectively.

A sealing member 154, which also prevents the waste toner from being scattered, is provided on the main housing 102 at each end portion of the second sub-opening 106. The first sub-housing 120 to be described later can be assembled to the main housing 102 through the second opening (see FIG. 2) to transfer the waste toner, which is removed from the OPC drum 200 by the cleaning blade 150, into a waste toner container (not shown).

The third sub-opening 108 can be formed on a bottom of the main housing 102 in a rectangular shape. A laser scanning unit (LSU) (not shown), which forms an image on the OPC drum using laser beam, is positioned to communicate with the OPC drum 200 through the third opening 108 to form an image on the OPC drum 200 through the third sub-opening 108.

The fourth sub-opening 110 can be formed between the second sub-opening 106 and the third sub-opening 108, and the second sub-housing 130 and an electrification roller assembly 503, as shown in FIG. 2, are mounted on the main housing 102 through the fourth sub-opening 110. That is, the electrification roller assembly 503 having an electrification roller 505 and an electrification roller cleaning roller 504 can be mounted to be in contact with the OPC drum through the fourth sub-opening 110, and the second sub-housing 130 can be connected to the main housing 102, thereby enclosing (covering) the fourth sub-opening 110.

An auger roller 122 can be mounted inside of the first sub-housing 120 to transfer the waste toner toward a waste toner drop hole 126, and an auger roller gear 502 is provided on a side of the auger roller 122. A carriage space 128 can be formed inside of the first sub-housing 120 to temporarily carry the waste toner removed from the OPC drum 200, and a plurality of snap projections to be inserted into the main housing 102 can be formed at a lower end of the first sub-housing 120. The first sub-housing 120 can be connected to the main housing 102 via the screw holes 124 formed in the first sub-housing 120, thereby enclosing (covering) the second sub-opening 106.

The second sub-housing 130 can be provided with an electrostatic elimination light guide 132 on a side thereof, and a plurality of ribs 508 can be formed on an inner side of the second sub-housing 130. In addition, a plurality of screw holes 507 can be formed on the second sub-housing for screw connection. The electrostatic elimination light guide 132 serves to guide electrostatic elimination light to the OPC drum 200 to eliminate static electricity from the OPC drum 200. According to an aspect of this embodiment, the electrostatic elimination light guide 132 may be transparent or semitransparent. The plurality of ribs 508 prevent the toner removed by the electrification roller cleaning roller 504 from being scattered due to a rotation of the OPC drum 200, the electrification roller 505 and the electrification roller cleaning roller 504.

The gear assembly 500 may include first to fourth idle gears 506, 508, 510 and 512, an electrification roller cleaning roller gear 504, and an auger roller gear 502, as shown in FIGS. 2 and 3. The first to third idle gears 506, 508 and 510 can transmit a power received from a flange gear 222 disposed on a side flange 220 of the OPC drum 200 to the electrification roller cleaning roller gear 504 to clean the electrification roller 505, and the fourth idle gear 512 can transmit the power from the electrification roller cleaning gear 504 to the auger roller gear 502.

As shown in FIG. 2, the brackets 400 can be mounted on the opposite sides of the main housing 102 by coupling the brackets 400 to shafts 114 of the main housing 102 through bracket holes 402 using a plurality of screws, and each bracket 450 may include a shock absorbing bar 404, a coil spring 406, and a support member 408. The shock absorbing bar 404 comes in contact with the image transfer unit (not shown) when the image transfer unit is seated on a top end of a housing assembly 101 of FIG. 4, the coil spring 406 can elastically support a bottom of the shock absorbing bar 404, and the support member 408 can receive the coil spring 406 and the shock absorbing bar 404 and can be secured to the main housing 102. As a result, when the image transfer unit (not shown) is seated on the top end of the housing assembly 101, the bracket 400 can absorb an impact.

The handle 300 can be provided with openings 306 to correspond to a shaft 118 of the main housing 104, so that it can be hingedly connected to the opposite sides of the main housing 102 by coupling ends of the lateral leg part 304 to shafts 118 formed on the respective opposite sides of the main housing 102 through openings 306, and may include an anti-slip part 302 and lateral leg parts 304. Each of the lateral leg parts 304 can be formed with a hook part 308 to be latched to a flange seating part 115 of the main housing 102. Additionally, a housing assembly of the OPC unit 100 having the OPC drum 200 and used with an image forming apparatus having one or more developing units and the image transfer unit may include the main housing 102 having opposite sides to correspond to the side flanges 220 of the OPC drum 200, a plate 601 formed between the opposite sides to correspond to an image forming surface of the OPC drum 200 in a circumferential direction of a rotation axis of the OPC drum 200 and having an angle larger than 18020 with respect to the rotation axis of the OPC drum 200 to define with the opposite sides the main opening 103 through which a portion less than 50% of the image forming surface of the OPC drum 200 is exposed a sub-opening (e.g., 108, 110, 106, and/or 104) formed on the plate 601 in a direction along the rotation axis of the OPC drum 200, and a sub-housing (e.g. 120 and/or 130) attached to the main housing 102 to communicate with the image forming surface of the OPC drum 200 through the sub opening (e.g., 108, 110, 106, and/or 104).

Hereinbelow, an operating relationship of the inventive housing assembly 101 constructed as described above in a state that the housing assembly 101 is assembled with the OPC drum will be described in detail.

When the OPC unit 100 shown in FIG. 3 is mounted in a main body of an image forming apparatus (not shown), a power source (not shown) can be inserted into the main housing 102 through a power source insertion part 116 (see FIG. 3) to be engaged with the flange gear 222. Upon being engaged in this manner, the flange gear 222 can be rotated by the power source to rotate the OPC drum 200, and also can render the first idle gear 506 engaged with the flange gear, the second idle gear 508, and third idle gear 510 to be rotated in sequence. The third idle gear 510 can rotate the electrification roller cleaning roller 504, so that the electrification roller cleaning roller 504 can perform cleaning of the electrification roller 505 while being rotated and being in contact with the electrification roller 505. The electrification roller cleaning roller 504 can rotate the fourth idle roller 512, and the fourth idle roller 512 can rotate the auger roller gear 502, so that the auger roller 122 and auger 123 transfer the waste toner. Yellow, magenta, cyan and black developers (not shown) are individually positioned in the main opening 103 of the main housing 102, and an image transfer medium (not shown) is disposed to face the OPC drum 200 through the first sub-opening 104 with a nip or gap being formed therebetween.

Firstly, if the OPC drum 200 is exposed through the third sub-opening 108, an image to be printed can be formed on the OPC drum 200. According to the image formed in this manner, respective color developing units (not shown) come into contact with the OPC drum 200 with a developing gap or nip to develop the image with respective colors. The developed toner image can be transferred to the image transfer medium (not shown) through the first sub-opening 104. The waste toner, remaining on the OPC drum 200 after image transfer, can be removed by the cleaning blade 150 and then can drop into the carriage space 128 provided inside of the first sub-housing 120 through the second sub-opening 106. Thereafter, the waste toner can be moved to the waste toner drop hole 126 by the auger roller 122 and the auger 123 and then freely drops into a waste toner sump (not shown). When the cleaning is completed, electrostatic elimination is performed using the electrostatic elimination light guide 132 and the fourth sub-housing 110.

The housing assembly of an OPC unit as constructed above according to this embodiment of the present general inventive concept can reduce an area to be contaminated by external environment by covering at least half the large-diameter OPC drum in the color image forming apparatus.

In addition, due to the presence of the main opening 103, contact between the fixed color developing units and the OPC drum can be improved, which consequently contributes improvement of an image developing quality.

Also, the inventive housing assembly is excellent in assemblability, and, by providing the handle 300 and the waste toner carriage space in the housing assembly, it is easy to mount and dismount the OPC unit and to remove the waste toner.

Although a few embodiments of the present general inventive concept have been shown and described, it will be appreciated by those skilled in the art that changes may be made in these embodiments without departing from the principles and spirit of the general inventive concept, the scope of which is defined in the appended claims. Therefore, it shall be considered that such modifications, changes and equivalents thereof are all included within the scope of the present invention.

What is claimed is:

1. A housing assembly of an OPC unit to protect an OPC drum, on which an image to be printed on a recording paper is formed in an image forming apparatus, the housing assembly comprising:

a main housing having a first portion to enclose at least a half of a photoconductive surface of the OPC drum and a second portion to define a main opening, the first portion having at least one sub-opening extending therethrough; and at least one sub-housing mounted on an opposite side of the first portion of the main housing with respect to the photoconductive surface to correspond to the at least one sub-opening and to communicate with the photoconductive surface of the OPC drum by extending through the at least one sub-opening in the first portion of the main housing, wherein the at least one sub-opening in the first portion of the main housing includes a second sub-opening through which a waste toner is discharged and a fourth sub-opening through which an electrification light guide and an electrification roller assembly are mounted.

2. The housing assembly according to claim 1, wherein the image forming apparatus comprises a developing unit to communicate with the OPC drum via the main opening defined by the second portion of the main housing, and the at least one sub-opening in the first portion of the main housing comprises a plurality of sub-openings.

3. The housing assembly according to claim 2, wherein the image forming apparatus comprises an image transfer medium, and the plurality of sub-openings comprise a first sub-opening through which the OPC drum comes into contact with the image transfer medium by a gap, and a third sub-opening through which the OPC drum receives light corresponding to the image.

4. The housing assembly according to claim 3, further comprising:

the electrostatic elimination light guide and the electrification roller assembly, wherein the electrostatic elimination light guide and the electrification roller assembly communicate with the OPC drum through the fourth sub-opening.

5. The housing assembly according to claim 1, wherein the at least one sub-housing comprises a first sub-housing mounted with an auger and a second sub-housing mounted with an electrostatic elimination light guide.

6. The housing assembly according to claim 1, wherein the first portion of the main housing comprises a handle hingedly connected to opposite sides of the main housing.

7. The housing assembly according to claim 6, further comprising:

brackets installed on the respective opposite sides of the first portion of the main housing to absorb an external force exerted to the housing assembly.

8. A housing assembly of an OPC unit to protect an OPC drum, on which an image to be printed on a recording paper is formed in an image forming apparatus, the housing assembly comprising:

a main housing having a first portion to enclose at least a half of a photoconductive surface of a large-diameter OPC drum having a diameter of 100 mm to 150 mm and a second portion to define a main opening through which a color developer selectively comes into contact with the large-diameter OPC drum;

at least one sub-opening extending through a surface of the first portion of the main housing to provide access to the photoconductive surface of the OPC drum, the at least one sub-opening including a second sub-opening in the first portion of the main housing through which a waste toner is discharged and a fourth sub-opening through which an electrostatic elimination light guide and an electrification roller assembly are mounted; and at least one sub-housing mounted outside the first portion of the main housing to communicate with the photoconductive surface of the OPC drum by extending through the at least one sub-opening in the first portion of the main housing.

9. The housing assembly according to claim 8, wherein the first portion of the main housing comprises a plurality of sub-openings for the exposure and removal of the waste toner, and the at least one of sub-housing comprises a first sub-housing mounted in the second sub-opening on the first portion of the main housing and provided with an auger and a second sub-housing provided with the electrostatic elimination light guide.

10. The housing assembly according to claim 9, wherein the image forming apparatus comprises an image transfer medium, and the plurality of sub-openings further comprise:

a first sub-opening through which the OPC drum comes into contact with the image transfer medium; and a third sub-opening through which the OPC drum receives light corresponding to the image.

11. The housing assembly according to claim 9, wherein the first sub-housing comprises:

a carriage space to temporarily carry the waste toner;

an auger roller to unidirectionally transfer the waste toner; and a waste toner drop hole from which the waste toner escapes.

12. The housing assembly according to claim 9, wherein the second sub-housing comprises a plurality of ribs to prevent the waste toner from being scattered.

13. The housing assembly according to claim 8, further comprising:

a handle hingedly connected to the first portion of the main housing; and a plurality of brackets mounted on opposite sides of the main housing.

14. A housing assembly of an OPC unit having an OPC drum and used with an image forming apparatus having one or more developing units and an image transfer unit, comprising:

a main housing having opposite sides to correspond to side flanges of the OPC drum, a curved housing plate formed between the opposite sides to correspond to an image forming surface of the OPC drum in a circumferential direction of a rotation axis of the OPC drum and having an angle larger than 180° with respect to the rotation axis of the OPC drum to define with the opposite sides a main opening through which a portion less than 50% of the image forming surface of the OPC drum is exposed;

a sub-opening formed on the curved housing plate in a direction along the rotation axis of the OPC drum; and a sub-housing attached to the main housing to communicate with the image forming surface of the OPC drum through the sub opening.

15. The housing assembly according to claim 14, wherein the OPC drum comprises a drum axle formed in the direction along the rotation axis of the OPC drum, and the opposite sides of the main housing comprises a slit to receive the drum axle to rotatably support the OPC drum.

16. The housing assembly according to claim 15, wherein the slit is formed on a corresponding one of the opposite sides of the main housing in a direction from a portion corresponding to the rotation axis of the OPC drum toward the main opening.

17. The housing assembly according to claim 15, further comprising:

a bracket attached to the main housing to prevent the drum axle from being released from the slit when the OPC drum is assembled into the main housing.

18. The housing assembly according to claim 17, wherein the bracket is fixedly coupled to a corresponding one of the opposite sides of the main housing.

19. The housing assembly according to claim 17, wherein the bracket comprises a hole to receive the drum axle which is disposed in the slit of the main housing.

20. The housing assembly according to claim 17, wherein the bracket comprises an elastic member movably mounted on the bracket to absorb a force exerted from the image transfer unit when the image transfer unit comes in contact with the OPC unit.

21. The housing assembly according to claim 20, wherein the bracket is not movable with respect to the main housing when the elastic member is movable according to the force exerted from the image transfer unit to the OPC unit.

22. The housing assembly according to claim 17, further comprising:

a plurality of gears disposed between the bracket and a corresponding one of the opposite sides of the main housing to transfer a rotation force to the sub-housing.

23. The housing assembly according to claim 22, wherein the sub-housing comprises one of an auger roller and an electrification roller of the electrification roller assembly, and the rotation force is transmitted to the one of the auger roller and the electrification roller through the gears.

24. The housing assembly according to claim 14, further comprising:

a handle having leg parts rotatably coupled to corresponding ones of the opposite sides of the main housing.

25. The housing assembly according to claim 24, wherein the handle has a length corresponding to a length of the OPC drum in the rotation axis of the OPC drum.

26. The housing assembly according to claim 14, wherein the sub-housing communicate with a portion of the image forming surface of the OPC drum through the sub-opening to form an image on the image forming surface of the OPC drum, to remove a toner from the image forming surface of the OPC drum, or to transfer the image from the image forming surface of the OPC drum to the image transfer unit.

27. The housing assembly according to claim 26, wherein the toner is supplied from the developing unit through the main opening.

28. The housing assembly according to claim 14, wherein the sub-housing comprises an auger roller and an auger formed on the auger roller to receive the waste toner removed from the OPC drum through the sub-opening.

29. The housing assembly according to claim 14, wherein the sub-housing comprises the electrification roller assembly and the electrostatic elimination light guide to communicate with OPC drum through the sub-opening to modify a potential of the image forming surface of the OPC drum.

30. The housing assembly according to claim 14, wherein the developing unit communicates with the exposed image forming surface of the OPC drum through the main opening, and the sub-opening comprises:

a first sub-opening, the second sub-opening, a third sub-opening, and the fourth sub-opening each having a length along the rotation axis of the OPC drum and a width along the circumferential direction of the rotation axis and formed on the curved housing plate of the main housing to be parallel to one another to communicate with different portions of the image forming surface of the OPC drum.

31. The housing assembly according to claim 30, wherein the first, second, third, and fourth widths are different from one another.

32. The housing assembly according to claim 30, wherein the first, second, third, and fourth sub-openings have the different length.

33. The housing assembly according to claim 30, wherein the sub-housing comprises:

a first sub-housing to communicate with a first portion of the image forming surface of the OPC drum through the second sub-opening to remove a remaining toner from the OPC drum; and a second sub-housing to communicate with a second portion of the image forming surface of the OPC drum through the fourth the fourth sub-opening to modify a potential of the image forming surface of the OPC drum.

34. The housing assembly according to claim 33, wherein the image transfer unit communicates with the image forming surface of the OPC drum through the first sub-opening to receive an image from the OPC drum.

35. The housing assembly according to claim 34, wherein the image forming surface of the OPC drum receives a light beam through the third sub-opening so that the potential is changed to a second potential by the light beam.

36. The housing assembly according to claim 35, further comprising:

a handle having leg parts coupled to corresponding ones of the opposite sides of the main housing and a part formed between the leg parts to be disposed above the curved housing plate between the main opening and the second sub-opening.

* * * * *